United States Patent [19]

Bouy et al.

[11] 4,042,483

[45] Aug. 16, 1977

[54] ELECTROLYSIS CELL ELECTRODE AND METHOD OF PREPARATION

[75] Inventors: Pierre Bouy, Enghien-les-Bains; Guy Cheradame, Pont-de-Claix, both of France

[73] Assignee: Rhone-Progil, Paris, France

[21] Appl. No.: 634,140

[22] Filed: Nov. 21, 1975

Related U.S. Application Data

[63] Continuation of Ser. No. 486,052, July 5, 1974, abandoned.

[30] Foreign Application Priority Data

| | | |
|---|---|---|
| July 20, 1973 | France | 73.26693 |
| May 13, 1974 | France | 74.16409 |

[51] Int. Cl.[2] ..... C25B 11/08; C25C 7/02; C25D 17/10

[52] U.S. Cl. ..... 204/290 F; 427/58; 427/115; 427/126; 427/377; 427/380

[58] Field of Search ..... 427/115, 126, 380, 377, 427/58; 204/290 F

[56] References Cited

U.S. PATENT DOCUMENTS

| | | | |
|---|---|---|---|
| 3,399,966 | 9/1968 | Suzuki | 204/290 |
| 3,706,644 | 12/1972 | Martinsons | 204/290 |
| 3,711,382 | 1/1973 | Anthony | 204/290 |
| 3,804,740 | 4/1974 | Welch | 204/290 |
| 3,917,525 | 11/1975 | Bouy et al. | 204/290 F |

FOREIGN PATENT DOCUMENTS

| | | | |
|---|---|---|---|
| 7,204,743 | 4/1972 | Netherlands | 204/290 |

*Primary Examiner*—Michael F. Esposito

[57] ABSTRACT

An improved electrode for an electrolysis cell, and the process for producing the same, are provided whereby there is deposited on a film-forming or barrier metal substrate, a compound of perovskite structure whereby the compound of perovskite structure is suspended in a solution of a cobalt salt which, by thermolysis, is converted to a cobalt oxide, and finally subjecting the resulting composite to a heating treatment.

13 Claims, No Drawings

ELECTROLYSIS CELL ELECTRODE AND METHOD OF PREPARATION

This is a continuation of application Ser. No. 486,052, filed July 5, 1974, now abandoned.

BACKGROUND OF THE INVENTION

The present invention relates to a new electrode which can be used in electrolytic cells serving for the production of chlorine, of caustic soda or of chlorates, and a new method of preparing said electrode. The cells serving for the production of chlorine and caustic soda are either diaphragm cells or mercury cells. The chlorates are produced in a cell whose structure is similar to that of the diaphragm cells but which, however, has no diaphragm.

The electrodes generally used as anode in these cells are frequently made of graphite. Their use has always entailed certain drawbacks resulting from their wear, causing an increase in the voltage necessary for the satisfactory operation of the electrolysis cell as the result of the consequent increase in the distance between anodes and cathodes and the contamination of the electrolyte.

Work has been directed to the development of anodes from a metal having good resistance to corrosion of the electrolyte and covered with an electrochemically active precious metal, the resulting composite then being subjected to a treatment which favors activation. These anodes are dimensionally stable and do not have the drawbacks mentioned above. For example, there have been proposed anodes having a core of zirconium, zirconium-titanium alloy, tantalum or niobium, covered with platinum. There has also been proposed a titanium anode covered with platinum. Titanium, like the other core metals mentioned above, being a barrier or film-forming metal is capable of forming a barrier or film layer of oxide in the electrolysis solutions in order to protect its surface from corrosion at the places where the platinum is porous.

Also, electrodes have been made of one of these film-forming metals or alloys capable of forming a barrier or oxide film layer, and covered with a precious metal oxide or mixtures of oxides of precious and non-precious metals.

Another type of electrode has also been described in the literature, which electrode comprises a substrate of a barrier or film-forming metal, such as titanium, covered with a surface of a perovskite. A perovskite is an oxygen compound of two different metals which is well known in the literature and may be represented by the formula:

$$A^a B^b O_3$$

in which A represents one metal ion and B another metal ion. A and B are related by the equation $a + b = 6$ in which $a$ and $b$ represent the conventional valences or ionic charges of the ions A and B, respectively. A discussion of the structure of perovskites is to be found, for instance, in "Crystal Structure" by Wyckoff, Vol. 2, 2nd edition (1964), Wiley and Sons, pages 390 to 402.

The drawback of these electroconductive layers of perovskites is that they are characterized by a high temperature of formation, greater than 800° C., and more particularly between 1,000° C. and 1,700° C., which does not permit the depositing in situ of these products on a metal support without damage to the latter.

The processes for the deposition of these mixed oxide perovskites generally encountered up to the present time consist in depositing the perovskite via an organic or inorganic binder on the core metal substrate. However, it is known that in order to improve the conductive properties of the electrode, it is necessary to interpose between the substrate and the perovskite an intermediate layer which is more resistant to oxidation under the anodic conditions than the substrate is.

The best results up to the present have been obtained by depositing between the substrate and the layer of perovskite, an intermediate layer of a metal of the platinum group, such as, for instance, rhodium, osmium, iridium or platinum or their alloys or an oxide of the metals of the platinum group. The electrodes obtained in this manner, although having good electrocatalytic properties, are not entirely satisfactory, since even greater thicknesses of precious metal are necessary to obtain the desired result. This makes the process uneconomical.

It is, accordingly, an object of the present invention to provide an improved electrolysis electrode and process for producing it which do not have the disadvantages of the prior art.

It is another object of the present invention to provide an improved electrode for an electrolytic cell employing a perovskite compound.

It is also an object of the present invention to provide an improved method of producing an electrode for an electrolytic cell, which electrode is produced from a perovskite compound.

Other objects will be apparent to those skilled in the art from the present description.

GENERAL DESCRIPTION OF THE INVENTION

We have discovered a novel method of manufacturing an electrode in which a layer of perovskite, composed preferably of a cobaltite of a rare earth metal, can be deposited directly on a substrate of a film-forming or barrier metal. This new method permits the elimination of the intermediate layer of precious metal, employed by the prior art, while assuring excellent electrocatalytic properties to the electrode.

These cobaltites are compounds having the formula $LnCoO_3$, in which Ln is at least one metal of the rare earth family of the Periodic Table of the elements. These rare earth cobaltites have a characteristic perovskite structure which is well known from crystallograms and is recognized by a special X-ray diffraction pattern. These cobaltites have a relatively high electrical conductivity which varies with the temperature, the rare earth playing an important part in the conductivity mechanism.

Also, the compounds of perovskite structure which can be used in accordance with the invention may be formed of other derivatives such as an aluminate of a rare earth metal.

The method of the invention makes it possible to obtain a new electrode of much longer life in the highly corrosive media of the electrolysis cells and having excellent electrocatalytic properties.

The method of manufacturing the electrodes of the invention comprises first of all preparing the compounds of perovskite structure. The rare earths or rare earth metals which can be used for the invention are those listed in the Periodic Table of the elements as such, including lanthanum, cerium, praseodymium, neodymium, samarium, europium, gadolinium, terbium, dysprosium, holmium, erbium, thulium, ytterbium and lutetium.

In the case of the rare earth cobaltites, cobalt oxide is mixed with one or more rare earths in the form of oxides, hydroxides or thermolyzable salts of said rare earths. The thermolyzable salts may, for instance, be the nitrates, sulfates or carbonates of rare earths. The cobalt oxide and the rare earths are mixed in stoichiometric proportions and in finely divided form and heated in an oxidizing atmosphere to temperatures between about 900° and 1,500° C. The time of heating the mixture in air or in an atmosphere of oxygen may range from about 72 hours down to about 2 hours. The mixture is allowed to cool and the resulting product is then crushed into a fine powder having preferably a particle size of not more than about 50 microns.

In the case of the aluminates of the rare earths, any known process for their preparation may be used. They may, for instance, be prepared by reaction at high temperature of an intimate mixture of the powdered oxides. One can heat mixtures of compounds whose pyrolysis leads to oxides, namely the carbonates, nitrates and hydroxides. In this case it is frequently advisable, in order to lower the reaction temperatures, to start from a double salt of the two constituent metals of the aluminate or from an intimate mixture of salts obtained by lyophilization or by supercritical evaporation of mixed solutions.

In accordance with the invention, the suspension of compound of perovskite structure is prepared by means of an aqueous solution of a cobalt salt, preferably cobalt nitrate, in the presence of a lower alkanol, such as isopropyl alcohol. The cobalt salt should be readily convertible, by thermolysis, to cobalt oxide. Cobalt nitrate performs this role very readily.

One or more layers of the resulting suspension are applied directly to the substrate of the film-forming or barrier metal to form the electrode. After each application of a layer, the electrode is kept in a furnace having an oxidizing atmosphere at a temperature of at least about 300° C., and preferably between about 300° and 500° C., for approximately a period of time ranging from about 5 minutes to 1 hour.

The layer of the compound of perovskite structure should preferably have a thickness corresponding to a deposit of at least about 5 milligrams per square centimeter of surface of film-forming metal. The upper limit of the thickness of the covering layer of the said compound is not critical. It is determined by the operating conditions of the electrode. Good results have been obtained with layers ranging from about 30 mg. to 100 mg. per square centimeter.

The barrier or film-forming metal of which the substrate is composed is a well known class of metals in this art, and includes, for instance, titanium, tantalum, tungsten, hafnium, zirconium, aluminum, niobium, and their alloys. Graphite may also be used and is included by the term "film-forming metal," as used herein.

It should be noted that the new method of preparing the electrodes in accordance with the invention does not require the presence of an intermediate layer which is more resistant to oxidation than the support metal of the substrate, that is to say, the layer or precious metal heretofore indispensable for the satisfactory operation of electrodes having a surface of perovskite.

It is known that cobalt oxide has a certain electrocatalytic activity but that this activity is not retained with the passage of the time as the result of a modification of the oxide leading to a substantial increase in potential when the electrode is used as anode in an electrolysis cell. In the case of the present invention, the electrodes have very good electrolytic stability during electrolysis. No satisfactory interpretation of this phenomenon has been found. However, it can be assumed that the cobalt oxide limits the formation of the layer of barrier metal oxide at the interface between the substrate and the compound of perovskite structure.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope on the invention nor limit the ambit of the appended claims. In the examples which follow, and throughout the specification, the quantities of material are expressed in terms of parts by weight, unless otherwise specified.

EXAMPLE 1

This example describes the preparation of an electrode composed of a deposit of gadolinium cobaltite on a titanium support.

The gadolinium cobaltite is prepared by crushing together 18.15 grams of gadolinium oxide ($Gd_2O_3$) of 99.9% purity and 8.28 grams of cobalt oxide containing 71% cobalt. The powder obtained is placed in an alumina crucible and then calcined at 1,200° C. for 15 hours in an atmosphere of air. The resulting product is allowed to cool in the furnace and is then crushed until particles of a size of less than 10 microns in diameter are obtained. This black powder thus obtained has an X-ray diffraction pattern characteristic of the perovskite structure of the gadolinium cobaltite.

A suspension of the resulting cobaltite is prepared in the following manner:

To 1 gram of black powder there are added 1 gram of cobalt nitrate hexahydrate, 1 ml. of water and 1 ml. of isopropyl alcohol. The resultant paste is agitated vigorously until a homogeneous suspension is obtained, the agitation being continued during the production of the suspension.

A sheet of titanium of a width of 10 mm., a length of 30 mm. and a thickness of 1 mm. is also prepared. The sheet is first cleaned by sanding and then washed with distilled water, then acetone, and then dried.

A layer of the suspension prepared above of cobaltite in the water-alcohol solution is brushed onto the prepared titanium sheet. After drying for 5 minutes in a stove at 100° C., the resulting electrode is kept for 10 minutes in an oven at 400° C. swept through by air. This operation is repeated in the same way twenty times. The quantity of product deposited is 40 milligrams per square centimeter of titanium sheet surface. The deposit is composed of 80% gadolinium cobaltite and 20% cobalt oxide, both by weight.

The electrode prepared in this manner is placed in an electrolysis cell for the manufacture of chlorine and caustic soda, in which the electrolyte is a 300 grams per liter solution of sodium chloride in water maintained at 80° C. and a pH of 4. A current of 25 amperes per square decimeter is passed through, which leads to an oxidation anode potential of chloride ions of 1,100 millivolts, referred to a saturated calomel electrode. After 500 hours of electrolysis, the anode potential remains unchanged.

EXAMPLE 2

This example describes the preparation of an electrode composed of a deposit of mixed gadolinium and terbium cobaltite ($Gd_{0.9}Tb_{0.1}CoO_3$) on a titanium support.

The mixed gadolinium and terbium cobaltite is prepared by crushing together 16.30 grams of gadolinium oxide ($Gd_2O_3$) of 99.9% purity, 1.87 grams of terbium oxide ($Tb_4O_7$) of 99.9% purity and 8.28 grams of cobalt oxide containing 71% cobalt. The resultant powder is placed in an alumina crucible and then calcined at 1,200° C. for 15 hours in an atmosphere of air. The product is allowed to cool in the furnace and is then crushed until particles of a size of less than 10 microns in diameter are obtained. The resulting black powder thus obtained has an X-ray diffraction pattern characteristic of the perovskite structure of the rare earth cobaltites.

A suspension of the resulting mixed cobaltite is then prepared in the following manner:

To 1 gram of the resulting black powder there are added 0.324 grams of cobalt nitrate hexahydrate, 1 ml. of water and 1 ml. of isopropyl alcohol. The paste thus obtained is agitated vigorously until a homogeneous suspension is obtained, the agitation being continued during the production of the suspension.

A sheet of titanium of 20 mm. width, 40 mm. length and 1 mm. thickness is also prepared. It is first of all cleaned by sanding and then washed with distilled water, then acetone, and then dried.

A layer of the suspension of cobaltite prepared above in the aqueous alcohol solution is then brushed onto the above titanium sheet. After drying for 5 minutes in an oven at 100° C., the electrode is kept for 10 minutes in a furnace at 400° C. while swept over by air. This operation is repeated twenty times. The amount of product deposited is 50 milligrams per square centimeter of titanium sheet surface. The deposit is composed of 93% mixed gadolinium and terbium cobaltite and 7% cobalt oxide.

The electrode thus prepared is placed in an electrolysis cell for the manufacture of chlorine and caustic soda, in which the electrolyte is a 300-grams per liter solution of sodium chloride maintained at 80° C. and a pH of 4. A current of 25 amps per. square decimeter is then passed through leading to an anodic oxidation potential of the chloride ions of 1,130 millivolts, referred to a saturated calomel electrode. After electrolysis for 300 hours, the anode potential remains unchanged.

EXAMPLE 3

This example describes the preparation of an electrode composed of a deposit of erbium aluminate on a titanium support.

The erbium aluminate is prepared by dissolving together 19.1 grams or erbium oxide ($Er_2O_3$) of 99.9% purity and 7.8 grams of alumina ($Al_2O_3$) trihydrate in concentrated nitric acid. The solution obtained is evaporated in an evaporator and the resultant powder is then calcined at 600° C. for 1 hr. After crushing, the powder is placed in an alumina crucible and then calcined at 900° C. for 15 hours in air. The product is allowed to cool in the furnace and then crushed to a particle size of less than 10 microns. The resulting granular black powder thus obtained has an X-ray pattern characteristic of the perovskite structure.

A suspension of the erbium aluminate is then prepared in the following manner:

To 1 gram of the guanular black powder there are added 1 gram cobalt nitrate hexahydrate, 1 ml. of water and 1 ml. of isopropyl alcohol. The paste obtained is agitated vigorously until a homogeneous suspension is obtained, the agitation being continued during the production of the suspension.

A sheet of titanium of a width of 20 mm., a length of 40 mm., and a thickness of 1 mm. is also prepared. It is first cleaned by sanding and then washed with distilled water, then acetone and then dried.

A layer of the aluminate suspension in the aqueous alcoholic solution is then brushed onto the titanium sheet. After drying for 5 min. in a stove at 100° C., the electrode is kept for 10 min. in a furnace at 400° C. while being swept by air. This operation is repeated 20 times. The amount of deposit is 40 mg. per square centimeter of titanium sheet surface.

The electrode which has thus been prepared is placed in an electrolysis cell for the manufacture of chlorine and caustic soda in which the electrolyte is a 300 grams per liter solution of sodium chloride maintained at 80° C. at a pH of 4. A current of 25 amps/dm2 is then passed through, leading to an oxidation anodic tension of the chloride ions of 1,110 millivolts, referred to a saturated calomel electrode.

As will be apparent to those skilled in the art from the foregoing disclosure, cobaltites and aluminates of other rare earth metals may be employed in the role of the perovskites in the foregoing examples.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process for preparing an electrode for an electrolysis cell by the direct depositing on a film-forming metal substrate, a compound of perovskite structure, characterized by directly depositing on the said substrate the said compound of perovskite structure consisting of a rare earth cobaltite having the formula $LnCoO_3$, in which Ln is at least one rare earth metal, said compound being suspended in a solution of cobalt nitrate, which, by thermolysis, may be converted to cobalt oxide, and then subjecting the said substrate and the resulting deposit thereon to a heat treatment in an oxidizing atmosphere at a temperature of at least about 300° C.

2. A process according to claim 1, characterized by the fact that the rare earth cobaltite is prepared by mixing the cobalt oxide together in stoichiometric proportions in finely divided form with at least one rare earth metal in the form of oxide, hydroxide or salt, and heating the resulting mixture in an oxidizing atmosphere at temperatures between 900° and 1,500° C. for a period of 72 hours to 2 hours.

3. A process according to claim 1, characterized by the fact that the rare earth cobaltite is prepared by mixing cobalt oxide together with gadolinium oxide.

4. A process according to claim 1, characterized by the fact that the rare earth cobaltite is prepared by mixing together cobalt oxide with gadolinium oxide and terbium oxide.

5. A process according to claim 1, characterized by the fact that the compound of perovskite structure consists of a rare earth metal aluminate.

6. A process according to claim 5, characterized by the fact that the said compound is formed of erbium aluminate.

7. A process according to claim 1, characterized by the fact that the compound of perovskite structure is in the form of a powder of a particle size of less than 50 microns.

8. A process according to claim 1, characterized by the fact that the solution of cobalt nitrate comprises cobalt nitrate, isopropyl alcohol and water.

9. A process according to claim 1, characterized by the fact that the substrate covered with the deposit is subjected to a heat treatment in an oxidizing atmosphere at a temperature between about 300 and 500° C.

10. A process according to claim 9, characterized by the fact that the substrate covered with the deposit is subjected to the heat treatment for a period of time of about 5 minutes to 1 hour.

11. A process according to claim 1, characterized by the fact that several layers are applied in succession to the substrate, and that after each application the newly covered substrate is subjected to heat treatment.

12. An electrode for an electrolysis cell produced by the process of claim 1.

13. An electrode according to claim 12, characterized by the fact that the substrate consists of titanium.

* * * * *